US006092479A

United States Patent [19]

Nozawa

[11] Patent Number: 6,092,479

[45] Date of Patent: Jul. 25, 2000

[54] TROUSERS-FLY-SEWING APPARATUS

[75] Inventor: Yasutoshi Nozawa, Toyama, Japan

[73] Assignee: YKK Corporation, Tokyo, Japan

[21] Appl. No.: 09/349,741

[22] Filed: Jul. 8, 1999

[30] Foreign Application Priority Data

Jul. 23, 1998 [JP] Japan ..... 10-241011

[51] Int. Cl.[7] ..... D05B 3/22; D05B 35/06; D05B 35/10

[52] U.S. Cl. ..... 112/470.33; 112/153; 112/475.07; 112/475.16

[58] Field of Search ..... 112/470.33, 470.03, 112/475.07, 475.09, 475.16, 104, 113, 153, 304, 306, 320

[56] References Cited

U.S. PATENT DOCUMENTS

| | | | |
|---|---|---|---|
| 4,611,546 | 9/1986 | Miyakawa . | |
| 5,069,148 | 12/1991 | Ishikawa et al. | 112/104 |
| 5,161,474 | 11/1992 | Ishikawa et al. | 112/153 X |
| 5,170,733 | 12/1992 | Honma et al. | 112/153 X |
| 5,701,833 | 12/1997 | Suzuki | 112/475.16 |

FOREIGN PATENT DOCUMENTS

| | | |
|---|---|---|
| 0 129 146 | 12/1984 | European Pat. Off. . |
| 1 320 765 | 6/1973 | United Kingdom . |

*Primary Examiner*—Peter Nerbun
*Attorney, Agent, or Firm*—Hill & Simpson

[57] ABSTRACT

In the apparatus, a lateral supply section is provided on one side of a fly-conveying passage, and an angle-changing member with a desired inclination angle is provided on the other side of the fly-conveying passage. A fly is supplied from the lateral supply section so as to abut on the angle-changing member and to be displaced at the desired inclination angle, then the fly is conveyed to a sewing section by a first longitudinal conveying belt and a second longitudinal conveying belt provided at a conveying section with the displacement of the fly being maintained. Thereafter, a slide fastener chain is placed and sewn onto the fly, thereby mechanically manufacturing the fly to which the slide fastener chain is sewn diagonally. The thus finished fly with the slide fastener chain is good and uniform in quality while its manufacturing can be efficient.

9 Claims, 7 Drawing Sheets

TROUSERS-FLY-SEWING APPARATUS

BACKGROUND OF THE INVENTION

1. Field of the Invention

The present invention relates to a trousers-fly-sewing apparatus, and more particularly to a trousers-fly-sewing apparatus which can mechanically manufacture a fly to which a slide fastener chain is sewn diagonally.

2. Description of the Related Art

As a conventional apparatus for mechanically sewing a slide fastener chain to a fly for trousers, there is an apparatus disclosed in, for example, Japanese Patent Publication No. 63-9878. The known apparatus is for sewing the slide fastener chain to the fly in a parallel posture. When the slide fastener chain is to be diagonally sewn to the fly so as to improve appearance of overlapping portions of left and right bodies of the trousers in a vicinity of a belt when the trousers are worn, the fly was supplied diagonally to a sewing machine by manual work to sew the slide fastener chain to the fly. Thus, an apparatus for mechanically, continuously and diagonally sewing the slide fastener chain has not been known.

Conventionally, since the slide fastener chain was sewn to the fly by manual work when the slide fastener chain is to be sewn diagonally to the fly, variations in an attaching position of the slide fastener chain are generated, a work efficiency is low, and the finished products are not good in quality.

SUMMARY OF THE INVENTION

It is an object of the present invention to provide a trousers-fly-sewing apparatus for diagonally sewing a slide fastener chain, wherein the above-mentioned problems are solved, an attaching position of the slide fastener chain is constantly the same and variations at the position are not generated, a work efficiency is high, and the finished products are good in quality.

To achieve the above object, according to the present invention, there is provided a trousers-fly-sewing apparatus wherein a fly-conveying passage is provided at a conveying section for carrying a fly for trousers to a sewing section for sewing a slide fastener chain to the fly, an angle-changing member having a desired inclination angle with respect to a conveying direction of the fly is disposed at one side portion of the fly-conveying passage, the fly supplied to the fly-conveying passage from a supply section is displaced diagonally to cause a side end portion of the fly to abut on the angle-changing member, and the fly displaced diagonally is conveyed from the conveying section to the sewing section where the slide fastener chain is sewn to the fly, thereby manufacturing the fly for trousers to which the slide fastener chain is sewn with a desired inclination angle.

When the changing member is provided such that the inclination angle can be adjusted to a desired inclination angle with respect to the conveying direction of the fly, the flies with various different inclination angles of the slide fastener chains H can be manufactured by the single apparatus. When the angle-changing member is provided so as to ascend and descend such that the angle-changing member can abut on and retreat from the fly, the displaced fly can be conveyed smoothly without interference with the angle-changing member.

Furthermore, the supply section maybe a lateral supply section that is disposed on a side of the fly-conveying passage and supplies the fly to the fly-conveying passage in a lateral direction of the fly-conveying passage. The lateral supply section preferably has a plurality of follower rollers for supplying the flies, and each follower roller is adjustable so that the side end portion of the fly reliably abuts on the angle-changing member.

Alternatively, the supply section maybe a longitudinal supply section that is on an upstream side of the fly-conveying passage and supplies the fly to the fly-conveying passage in a longitudinal direction of the fly-conveying passage. The longitudinal supply section is preferably connected to the conveying section having a plurality of driving rollers, and each driving roller has directions of rotary shafts which are adjustable so that the side end portion of the fly abuts on the angle-changing member.

Preferably, the conveying section may have a longitudinal conveying belt which is disposed above the fly-conveying passage and which can ascend and descend, and the longitudinal conveying belt carries the fly to the sewing section while pressing the fly when the longitudinal conveying belt descends. It is also preferable that the conveying section has a first longitudinal conveying belt and a second longitudinal conveying belt, the second longitudinal conveying belt is positioned between the sewing section and the first longitudinal conveying belt, such that a rear portion of the second longitudinal conveying belt on a side toward the first longitudinal belt can ascend and descend, and both succeeding and preceding flies can be simultaneously conveyed and successively conveyed to the sewing section of the slide fastener chain while being pressed after the succeeding fly is caused to abut on the preceding fly.

DESCRIPTION OF THE PREFERRED EMBODIMENTS

Figure 1:
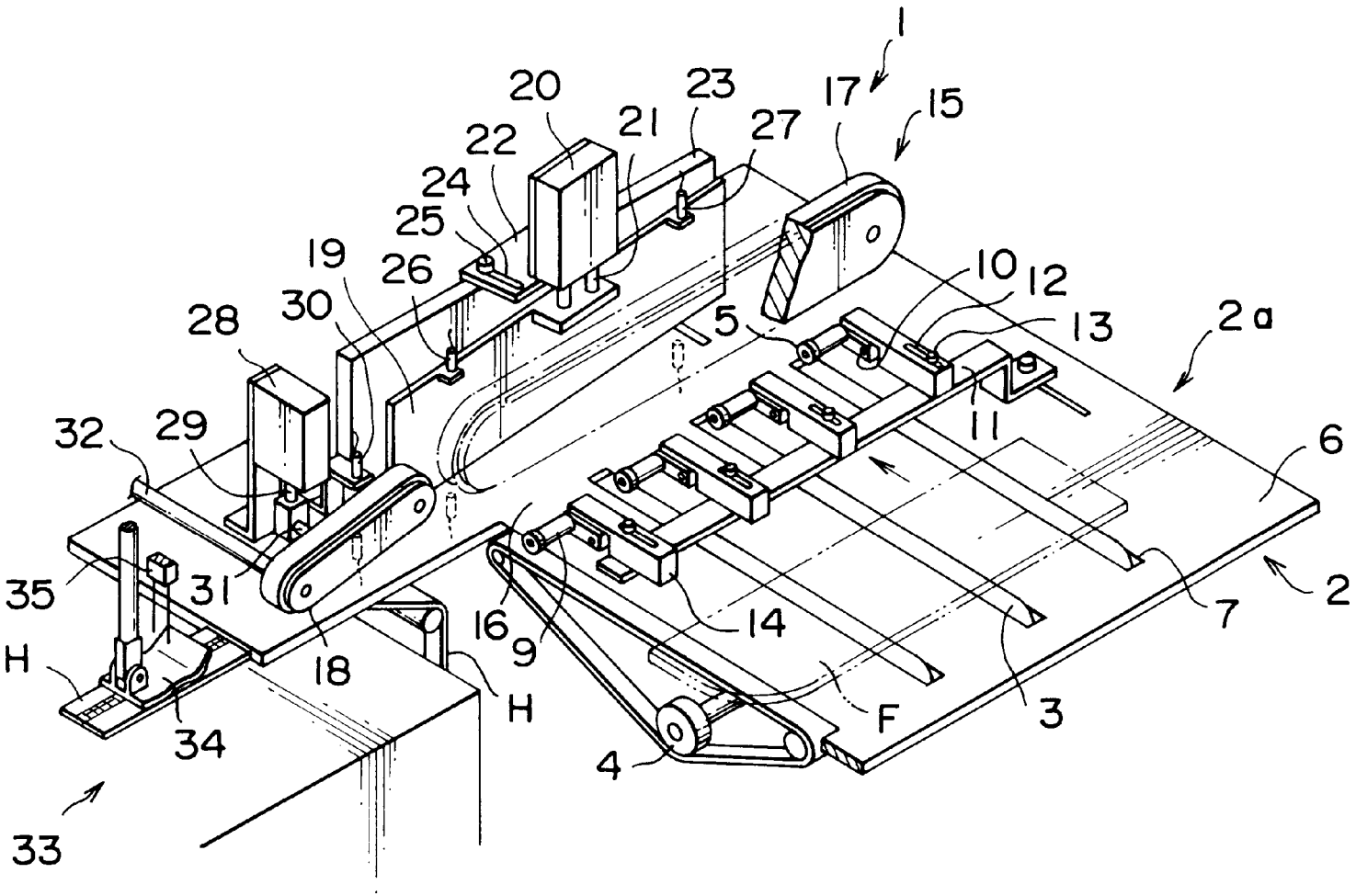
FIG. 1 is a perspective view of a fly-sewing apparatus of the present invention.

Embodiments of the present invention will be described below based on examples shown in the drawings.

Figure 8:
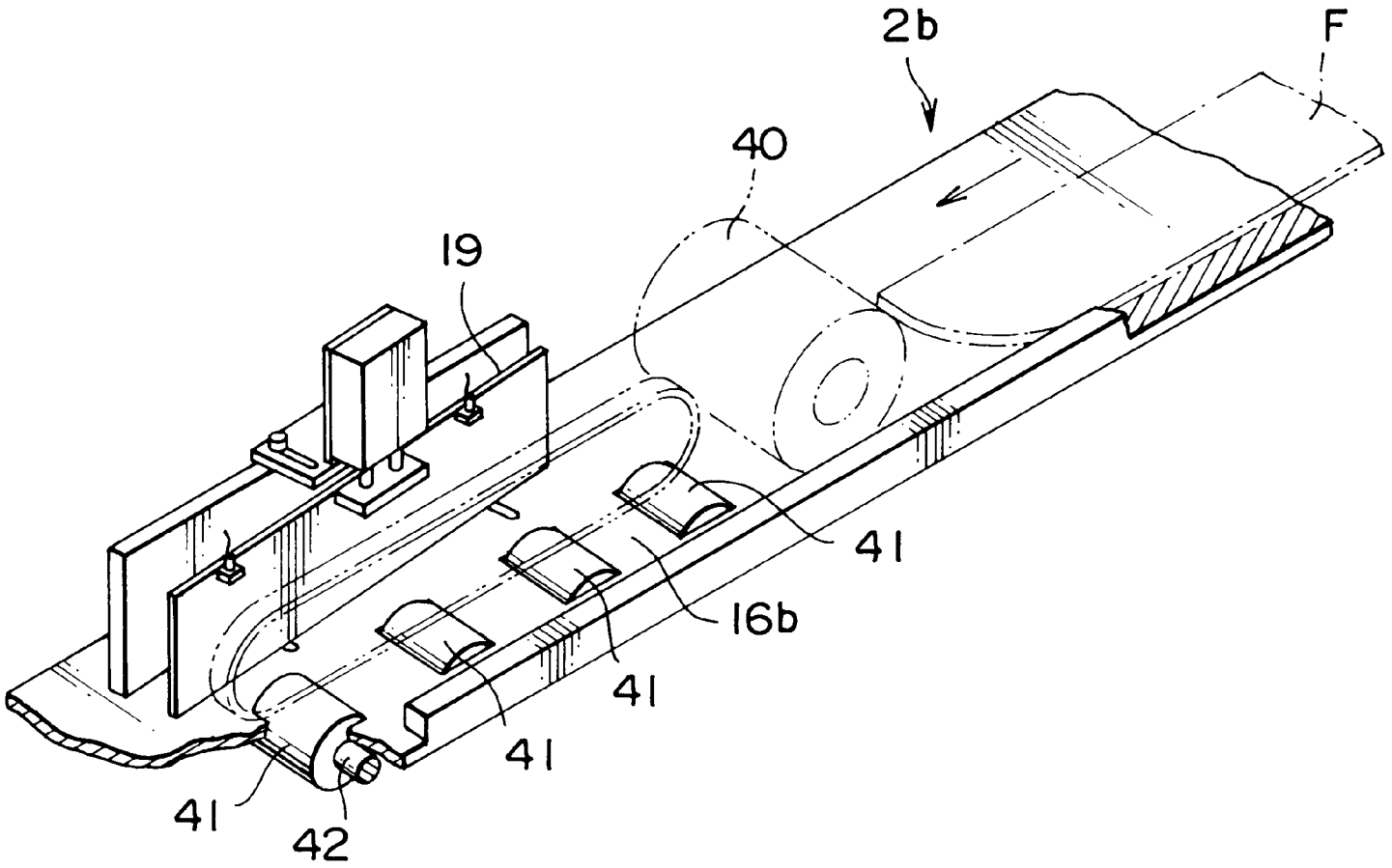
FIG. 8 is a perspective view of an essential portion including a longitudinal supply section of a second embodiment of the invention.

A fly-sewing apparatus 1 of the invention comprises a supply section 2, a conveying section 15, and a sewing section 33. According to a first embodiment of the present invention, a fly F is supplied in a lateral direction of a fly-conveying passage 16 as shown in FIG. 1. According to a second embodiment of the present invention, the fly F is supplied in a longitudinal direction of the fly-conveying passage 16 as shown in FIG. 8.

Figure 10:
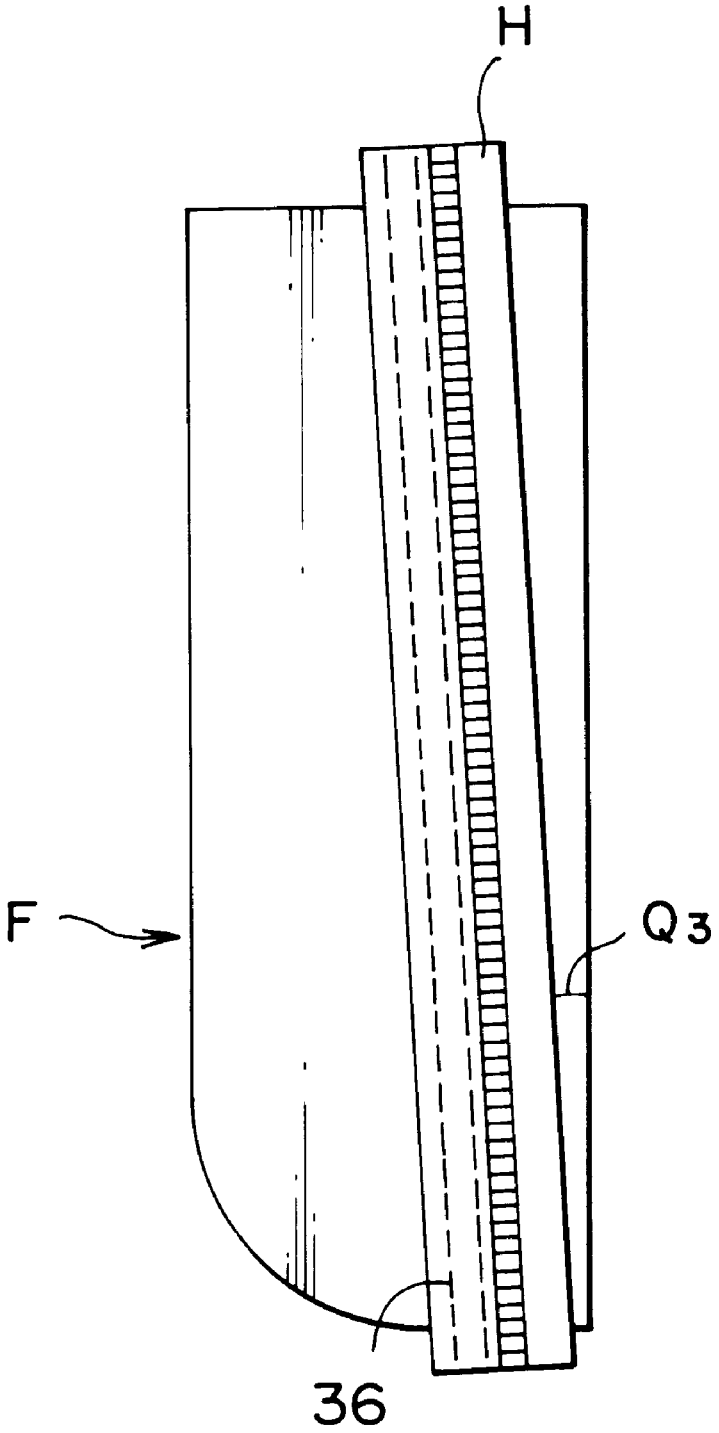
FIG. 10 is a plan view of the manufactured fly.

FIG. 1 shows an entire fly-sewing apparatus of the first embodiment, FIGS. 2 to 7 are explanatory views showing states wherein the fly F is diagonally displaced and conveyed by the present apparatus, and FIG. 10 shows a piece of fly manufactured by the apparatus of the present invention.

The fly-sewing apparatus 1 of the first embodiment of the present invention comprises a lateral supply section 2*a* as a supply section 2 for laterally supplying a fly F, a conveying section 15, and a sewing section 33 for a slide fastener chain H. The fly F is supplied by lateral conveying belts 3 to the conveying section 15. The fly F abuts on an angle-changing member 19, which will be described later, and is displaced to be brought into a desired diagonal state, and then is carried to the sewing section 33 for the slide fastener chain H. The long slide fastener chain H which has been supplied in parallel to a conveying direction of the fly F is sewn to the displaced fly F, thereby completing the fly F shown in FIG. 10.

Figure 2:
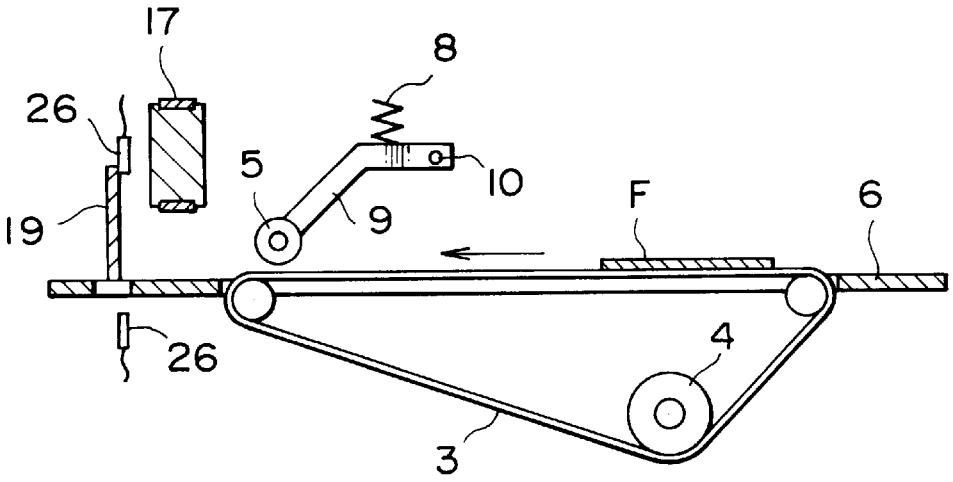
FIG. 2 is an explanatory view showing a state wherein a fly is supplied from a lateral supply section.
Figure 3:
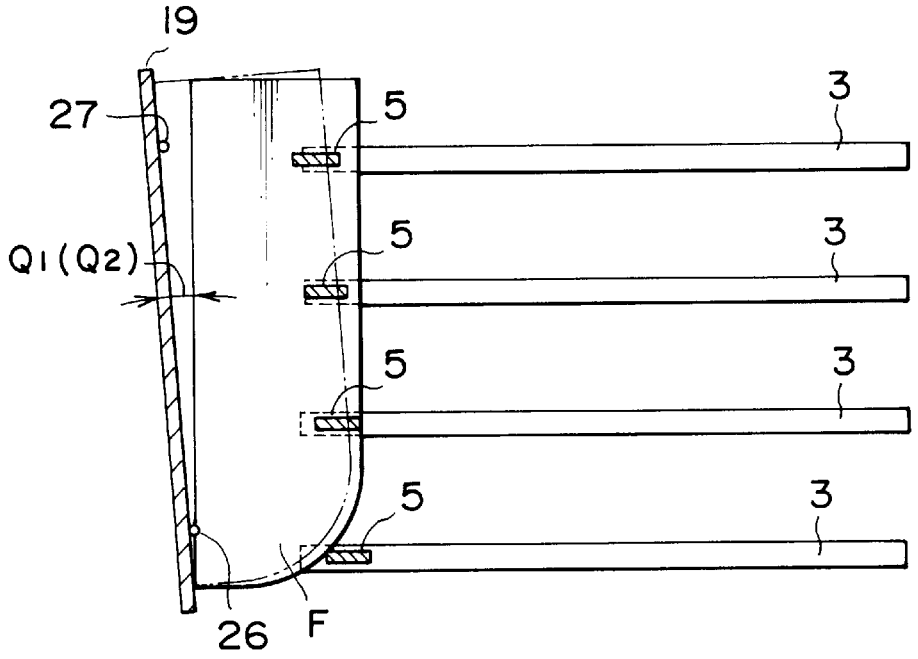
FIG. 3 is an explanatory view showing a relationship between follower rollers of the lateral supply section and the fly.

The lateral supply section 2*a* is provided on one side of the fly-conveying passage 16. The lateral supply section 2*a* supplies the fly F in a posture as shown by a chain double-dashed line in FIG. 1 and makes a side end portion of the fly F to abut on the angle-changing member 19 provided on the other side of the fly-conveying passage 16 so as to diagonally displace the fly F as shown in FIG. 1. The lateral supply section 2*a* comprises the lateral conveying belts 3, follower rollers 5, and a base plate 6. The plurality of lateral conveying belts 3 extend at a lower portion of the base plate 6 and are arranged side by side so as to be adapted to supply of flies F having various lengths, each of which has a small width. The lateral conveying belts 3 are rotated by a single driving roller 4. Upper running portions of the lateral conveying belts 3 project out of respective slits 7 formed in the base plate 6 so as to carry the fly F thereon and supplied it to the fly-conveying passage 16. An attaching frame 11 for attaching the follower rollers 5 are provided on an upper portion of the base plate 6 near the fly-conveying passage 16. A plurality of attaching members 14 for the follower rollers 5 which supply the fly F in cooperation with the lateral conveying belts 3 are attached side by side to the attaching frame 11 so as to be adjustable. Each follower roller 5 is rotatably attached to an arm 9 which is supported on the attaching member 14 by a support shaft 10 so as to be pivotally movable. The follower roller 5 is pressed against an upper face of each lateral conveying belt 3 by a spring 8 via the arm 9, so that the fly F can be securely forwarded to the fly-conveying passage 16 and abut on a side wall of the angle-changing member 19 on the opposite side while being prevented from becoming wrinkled, as shown in FIG. 2. Each attaching member 14 for the follower roller 5 is attached to the attaching frame 11 by a bolt 13 inserted through an elongated hole 12 so as to be adjustable in a supply direction of the fly F. The respective follower rollers 5, 5 . . . are disposed to be gradually displaced from each other so as to correspond to an inclination angle $Q_1$ of the angle-changing member 19 such that the fly F is fed to securely abut on the side wall of the angle-changing member 19 and that the fly F is conveyed in a state wherein the fly F is displaced and inclined as shown by a chain double-dashed line, as shown in FIG. 3. When the lateral conveying belts 3 can be disposed close to the angle-changing member 19 or when friction between the fly F and the belts 3 is large enough for the fly F to be conveyed without possibility of slippage, the follower rollers 5 may not be provided. A large number of rollers may be arranged in the supply direction of the fly F instead of the lateral conveying belts 3 such that the rollers are rotated to convey the fly F.

In the conveying section 15, the fly F supplied by the above-described lateral supply section 2*a* is displaced at a desired angle by the angle-changing member 19 and is conveyed to the sewing section 33. The conveying section 15 comprises the fly-conveying passage 16, the angle-changing member 19, a first longitudinal conveying belt 17, and a second longitudinal conveying belt 18.

Figure 4:
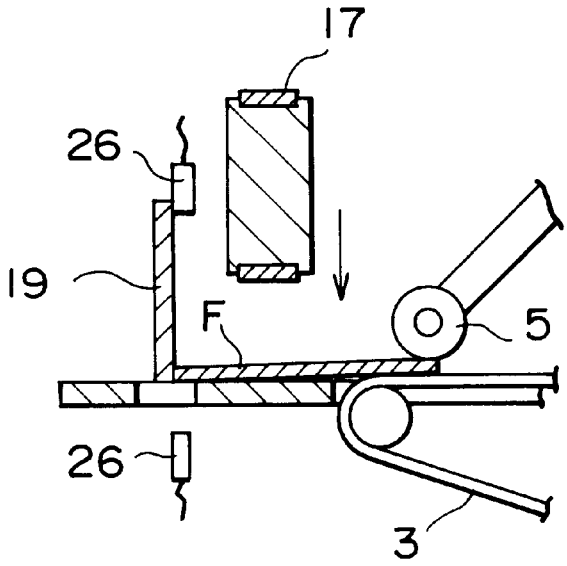
FIG. 4 is an explanatory view showing the fly abutting on an angle-changing member.
Figure 5:
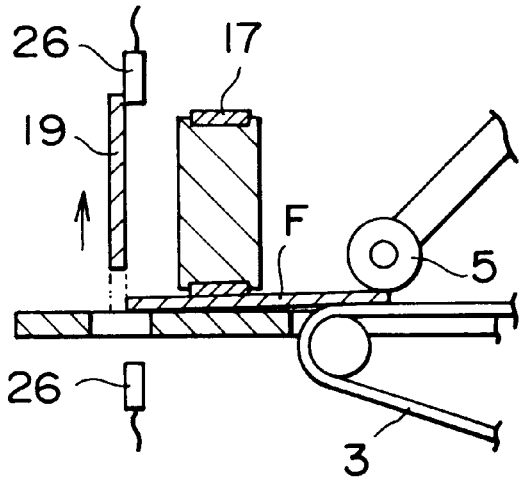
FIG. 5 is an explanatory view showing a state wherein a first longitudinal conveying belt presses the displaced fly.

The fly-conveying passage 16 has a smooth surface and conveys the supplied fly F to the sewing section 33. The angle-changing member 19 has a plate-shaped body and disposed on one side of the fly-conveying passage 16 opposite to the lateral conveying belts 3. As shown in FIGS. 3 and 4, the side end portion of the fly F which has been conveyed by the lateral conveying belts 3 is caused to abut on the side wall of the angle-changing member 19 such that the fly F is diagonally displaced, and then the fly F stops on the fly-conveying passage 16. Rods 21 of an ascending/descending cylinder 20 are fixed to a central upper end portion of the angle-changing member 19 and the angle-changing member 19 is supported for ascending and descending by being hung by the rods 21. An attaching plate 22 of the ascending/descending cylinder 20 is adjustably attached to a frame 23 by a bolt 25 inserted through an elongated hole 24. Therefore, it is possible to adjust the inclination angle $Q_1$ (equal to an inclination angle $Q_2$ of the fly F) of the angle-changing member 19 according to a size of the fly F, and to adjust a distance between the angle-changing member 19 and the fly-conveying passage 16 according to a difference in a sewing angle $Q_3$ of the slide fastener chain, if necessary. The angle-changing member 19 is provided at opposite end portions thereof with a first sensor 26 and a second sensor 27 which may be photoelectric detectors or the like. The first sensor 26 and the second sensor 27 sense whether or not the side end portion of the fly F which has been conveyed by the lateral conveying belts 3 has reached the side wall of the angle-changing member 19 as shown by a chain double-dashed line in FIG. 3, and when it does, the driving roller 4 of the lateral conveying belts 3 is stopped. The first longitudinal conveying belt 17 which has been lifted to allow the fly F conveyed by the lateral conveying section 2*a* to pass through is lowered to hold the fly F displaced by the angle-changing member 19 as shown in FIG. 4. Then, as shown in FIG. 5, the angle-changing member 19 ascends to retreat by an actuation of the ascending/descending cylinder 20 of the angle-changing member 19 such that the fly F on the fly-conveying passage 16 is conveyed to the sewing section 33 while maintaining its displacement. In this manner, the side end portion of the fly F which has been displaced diagonally is not brought into contact with the angle-changing member 19 so that the fly F can be stably conveyed in the displaced state.

Figure 6:
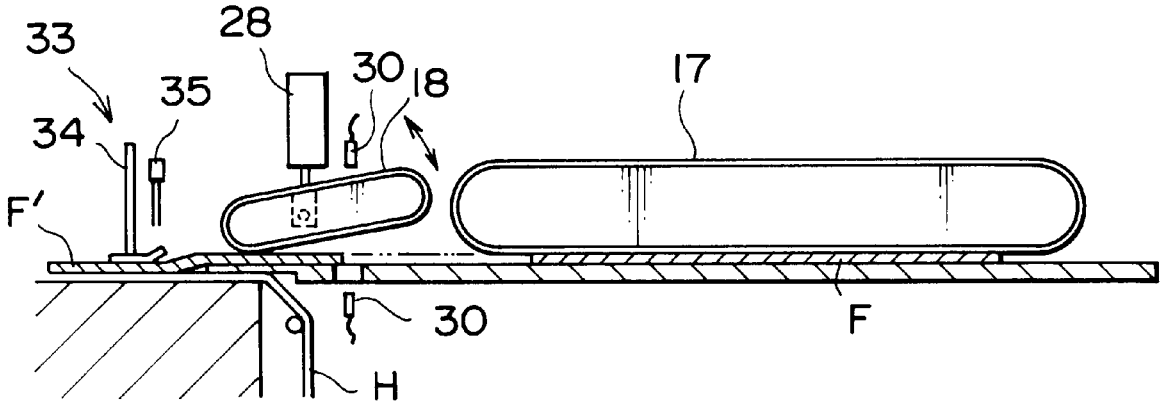
FIG. 6 is an explanatory view showing a state wherein a rear portion of a second longitudinal conveying belt has ascended.
Figure 7:
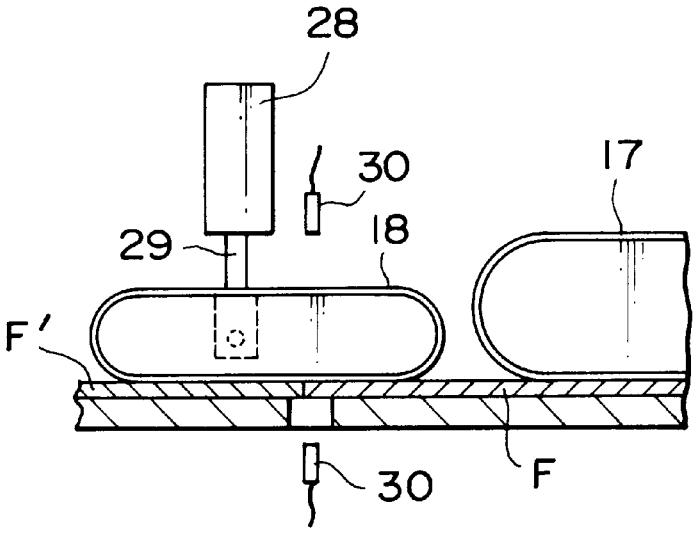
FIG. 7 is an explanatory view showing a state wherein the second longitudinal conveying belt has descended to press a front end of a succeeding fly.

The first longitudinal conveying belt 17 and the second longitudinal conveying belt 18 are arranged in a line on the fly-conveying passage 16 as shown in FIG. 1, and convey and successively supply the diagonally displaced flies F to the sewing section 33. As shown in FIG. 6, the first longitudinal conveying belt 17 has a length enough to cover and press the fly F and is mounted for ascending and descending by an ascending/descending cylinder (not shown) or the like so as to receive the fly F which has been supplied from the lateral supply section 2*a* and press the fly F against the fly-conveying passage 16. The first longitudinal conveying belt 17 is rotated independently from the second longitudinal conveying belt 18 by its own driving device (not shown) to feed the fly F to the second longitudinal conveying belt 18. The second longitudinal conveying belt 18 has an intermediate portion thereof attached to a connecting lever 31 for connecting a rod 29 of a belt swinging cylinder 28 to the second longitudinal conveying belt 18. As shown in FIGS. 1 and 6, a rear portion of the second longitudinal conveying belt 18 on the side toward the first longitudinal conveying belt 17 ascends and descends about a driving shaft 32 as a fulcrum of the second longitudinal conveying belt 18, the driving shaft 32 being mounted at a front portion of the second longitudinal conveying belt 18. A third sensor 30 which is a photoelectric detector or the like is mounted to a position near the rear portion of the second longitudinal conveying belt 18 as shown in FIGS. 6 and 7. In the case that absence of the fly F is sensed by the third sensor 30 when the fly F has been conveyed to the sewing section 33 and a rear end portion of the fly F has passed through the position of the third sensor 30, a command is input into the belt swinging cylinder 28. Then, the belt swinging cylinder 28 lifts the rear portion of the second longitudinal conveying belt 18 as shown in FIG. 6, and at the same time a rotation speed of the first longitudinal conveying belt 17 is increased to feed a succeeding fly F to the second longitudinal conveying belt 18 and to cause the succeeding fly F to abut on the rear end portion of the preceding fly F'. At this time, the third sensor 30 senses a presence of the succeeding fly F, the belt swinging cylinder 28 is actuated to lower the rear portion of the second longitudinal conveying belt 18 so as to be pressed against a forward end portion of the succeeding fly F as shown FIG. 7. Then, the speed of the first longitudinal conveying belt 17 is synchronized with a speed of the second longitudinal conveying belt 18 to successively convey the succeeding fly F after the preceding fly F' to the sewing section 33. As shown in FIG. 6, the long slide fastener chain H which has been fed separately below and in parallel to a feed direction of the fly is placed under the fly and is sewn from above by a needle 35. When the succeeding fly F is conveyed in a state wherein the fly F is completely pressed by the second longitudinal conveying belt 18, the first longitudinal conveying belt 17 ascends to be ready for receiving the fly F supplied from the lateral supply section 2*a* as shown in FIG. 2. The second longitudinal conveying belt 18 lifts its lower portion to be ready for receiving the next fly F when the succeeding fly F is conveyed further and the rear end portion of the succeeding fly F passes through a sensing position of the third sensor 30. In this manner, the fly F displaced at the desired inclination angle $Q_2$ can be fed to the sewing section 33 while abutting on the preceding fly F' and the long slide fastener chain H is sewn to the fly F, thereby completing the fly F for the trousers with the slide fastener H. By providing the first and second longitudinal conveying belts 17 and 18, a large number of flies F can be sewn in a state wherein the flies F are successively arranged in contact with each other in a longitudinal direction of the slide fastener chain H. Therefore, no portion of the slide fastener chain is wasted and an increase in manufacturing costs can be avoided. However, such two longitudinal conveying belts 17 and 18 are not necessarily provided. The above-described sewing of the fly F is possible by providing a single longitudinal conveying belt 17 in a vicinity of the sewing section 33 and by controlling supply of the fly F from the lateral supply section 2*a* and an actuating timing of conveying of the fly F by the longitudinal conveying belt 17.

As shown in FIGS. 1 and 6, at a lower portion of the sewing section 33 for the slide fastener chain H, there is arranged a position for supplying the long slide fastener chain H to be sewn. The slide fastener chain H is supplied to and laid under a lower side of the fly F and pressed by a presser foot 34. After sewing a tape portion on a side of the slide fastener chain H by the needle 35 as shown in FIG. 10, the slide fastener chain H is cut for every fly F, thereby producing the fly F to which the slide fastener chain H is sewn diagonally. The sewing inclination angle $Q_3$ of the slide fastener chain H is set small, normally about 5°. In the present invention, the sewing inclination angle $Q_3$ is set at the inclination angle $Q_1$ of the angle-changing member 19 and the fly F supplied laterally is caused to abut on the angle-changing member 19 such that the fly F is inclined. The slide fastener chain H supplied in parallel to the conveying direction is sewn to the inclined fly F such that the slide fastener chain H is sewn diagonally with respect to the fly F in a finished state as shown in FIG. 10. The inclination angle of the angle-changing member 19 can be adjusted in a range of +80° to −80°. As a result, the sewing inclination angle $Q_3$ of the slide fastener chain H can be set at a value within the range. When the attaching inclination angle of the angle-changing member 19 is set at a value in a range of 0 to −8°, the long slide fastener chain H is supplied from above the fly F and sewn thereto When the attaching inclination angle of the angle-changing member 19 is set at 0°, a product similar to a conventional product, i.e., a product wherein the slide fastener chain H is sewn in parallel to the longitudinal direction of the fly F can be obtained. As a result, by a single fly-sewing apparatus, it is possible not only to sew the slide fastener chain H to the fly F with a desired inclination angle as shown in FIG. 10, but also to sew the slide fastener chain H in parallel to the fly F. Therefore, it is possible to quickly meet the requirements for changing the sewing angle. Furthermore, because it is unnecessary to dispose a plurality of apparatuses with different sewing angles set therein, an increase in costs of equipment can be suppressed.

The first embodiment of the invention has been as described above. Because the fly F is supplied to the fly-conveying passage 16 from the lateral direction of the fly-conveying passage 16 such that shorter sides of the fly F are in parallel to the supply direction in this fly-sewing apparatus, the fly F resists being wrinkled due to frictional resistance generated in the supply. Therefore, the apparatus is suitable for supply of a fly which is very soft in itself, e.g., a fly for trousers such as casual trousers which is light clothing and mainly formed of soft cloth.

Figure 9:
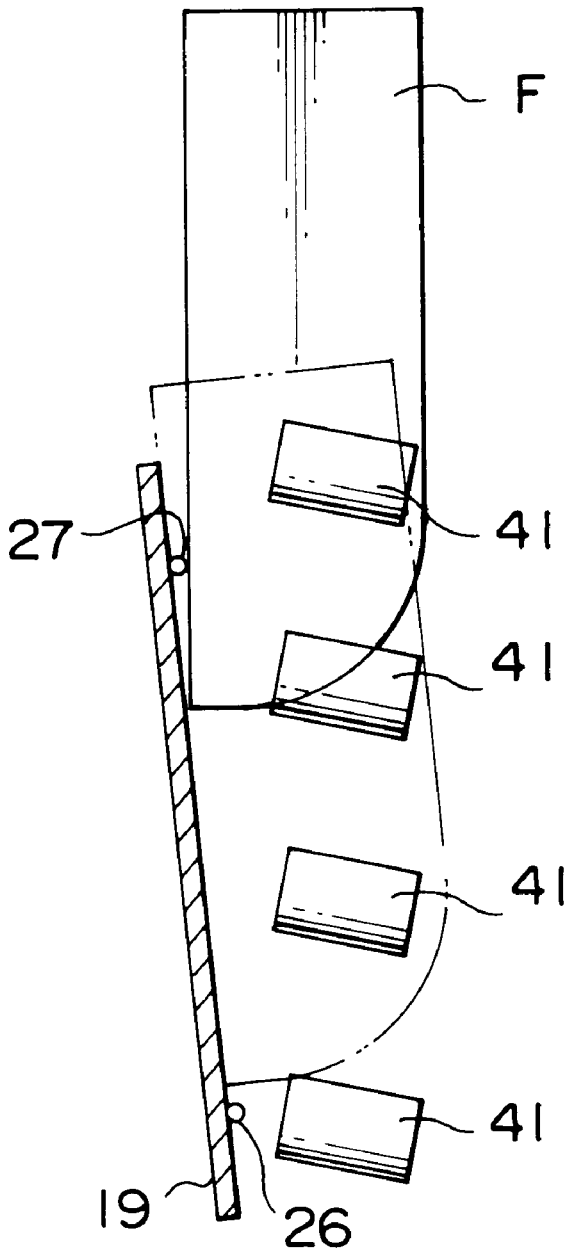
FIG. 9 is an explanatory view showing a state wherein the fly is displaced by the angle-changing member.

FIGS. 8 and 9 show a fly-sewing apparatus according to a second embodiment of the present invention. FIG. 8 shows a fly-conveying passage 16*b* and a longitudinal supply section 2*b* extending from the fly-conveying passage 16*b* toward an upstream side of a carrying direction of the fly F. In FIG. 8, illustration of a sewing section 33 on a downstream side of the conveying direction is omitted because it has the same structure as that of the first embodiment. Because structures of an angle-changing member 19 and a first longitudinal conveying belt 17 provided at one side portion of the fly-conveying passage 16*b* are the same as those of the first embodiment, descriptions of the only structures are omitted and structures which are different from those in the first embodiment will be described here.

In the second embodiment, in contrast to the first embodiment wherein the fly F is supplied to the fly-conveying passage 16 in the lateral direction of the fly-conveying passage 16, the fly F is supplied in a longitudinal direction of the fly-conveying passage 16*b*. The longitudinal supply section 2*b* extends from the fly-conveying passage 16*b* toward the upstream side of the conveying direction of the fly F as shown in FIG. 8 and positively supplies the fly F to the fly-conveying passage 16*b* by a driving supply roller 40. On a conveying passage face of the fly-conveying passage 16*b*, there is provided a plurality of driving rollers 41, 41 . . . which are arranged side by side in the conveying direction of the fly F. Each of the driving rollers 41, 41 . . . have a part of its upper faces slightly exposed from the supply passage face so as to contact with the supplied fly F.

A rotary shaft 42 of each of the driving rollers 41, 41 . . . is disposed to be slightly inclined with respect to a direction orthogonal to the conveying direction of the fly F on the fly-conveying passage 16*b* as shown in FIG. 9 such that the fly F is positively caused to abut on the angle-changing member 19 for displacement while being supplied longitudinally toward the fly-conveying passage 16*b*. After the fly F abuts on the angle-changing member 19 and is displaced, the fly F is conveyed to the sewing section 33 similarly to the first embodiment.

In the apparatus of the second embodiment, because the fly F is supplied to the fly-conveying passage 16*b* with longer sides of the fly F being in parallel to the supply direction, a normal fly which is not as soft as the very soft one which is applicable to the first embodiment or a fly which is for jeans formed of denim and which itself has rigidity can be supplied smoothly without being wrinkled.

In place of the driving rollers 41, 41 . . . , structures similar to the lateral conveying belts 3 used in the lateral supply section 2*a* in the first embodiment may be disposed diagonally in the same directions as those of the rotary shafts 42 of the respective driving rollers 41, 41 . . . . Furthermore, the rotary shafts 42 of the respective driving rollers 41, 41 . . . may be formed such that the directions of the rotary shafts 42 are adjustable according to the set angle of the angle-changing member 19. In conveyance of the fly F to the sewing section 33, the directions of the rotary shafts 42 of the respective driving rollers 41, 41 . . . may be displaced to be perpendicular to the conveying direction, synchronously with running of the longitudinal conveying belt 17, so as to assist the conveyance of the fly F.

According to the present invention, the angle-changing member 19 with a desired inclination angle is disposed at one side portion of the fly-conveying passage 16, 16*b*, the side end portion of the fly F supplied from the supply section 2 is displaced diagonally by being caused to abut on the angle-changing member 19, and then the fly F displaced diagonally is conveyed to the sewing section 33 of the slide fastener chain H by the conveying section 15 provided to the fly-conveying passage 16, 16*b*, and finally the slide fastener chain H is sewn to the fly F. Therefore, the fly F to which the slide fastener chain H is sewn while being inclined at a desired inclination angle can be mechanically and easily manufactured. Moreover, because variations are not generated in the manufactured flies F, constant quality can be maintained at all times, and work efficiency is more increased.

Further, because the inclination angle of the angle-changing member 19 can be adjusted, it is possible to easily meet the requirements for flies F to which the slide fastener chains H are sewn with various inclination angles. Furthermore, because the angle-changing member 19 can ascend and descend, the displaced fly F can be smoothly conveyed to the sewing section 33 without interference with the angle-changing member 19 while maintaining the predetermined inclination angle.

Still further, because the follower rollers 5 with adjustable disposing positions are provided to the lateral supply section 2*a*, or because the longitudinal supply section 2*b* is connected to the conveying section 25 having the driving rollers 41, 41 . . . with directions of their rotary shafts 42, 42 . . . being adjustable, the supplied fly F can be reliably caused to abut on the angle-changing member 19 even if the attaching angle of the angle-changing member 19 is changed. Therefore, the flies F displaced uniformly can be conveyed to the sewing section 33 at all times, and the flies F without variations and with constant quality can be manufactured.

Still further, because the rear portion of the second longitudinal conveying belt 18 disposed near the sewing section 33, which is a portion toward the first longitudinal conveying belt 17, can ascend and descend, the front end of the succeeding fly F can be brought into contact with and caused to abut on the rear end of the preceding fly F'. Thus, the flies F can be successively carried to the sewing section 33, thereby increasing work efficiency. Furthermore, because the flies F are conveyed with the front end of the succeeding fly F and the rear end of the preceding fly F' being pressed from above by the second longitudinal conveying belt 18, the flies F can be conveyed with their displaced states being maintained. As a result, variations are not generated in quality of finished products, and products with constant quality can be manufactured at all times.

What is claimed:

1. A trousers-fly-sewing apparatus, wherein a fly-conveying passage is provided at a conveying section for carrying a fly for trousers to a sewing section for sewing a slide fastener chain to said fly, an angle-changing member having a desired inclination angle with respect to a conveying direction of said fly is disposed at one side portion of said fly-conveying passage, said fly supplied to said fly-conveying passage from a supply section is displaced diagonally to cause a side end portion of said fly to abut on said angle-changing member, and said fly displaced diagonally is conveyed from said conveying section to said sewing section where said slide fastener chain is sewn to said fly, thereby manufacturing said fly for trousers to which said slide fastener chain is sewn with a desired inclination angle.

2. A trousers-fly-sewing apparatus according to claim 1, wherein said angle-changing member is provided such that said inclination angle can be adjusted to a desired inclination angle with respect to the conveying direction of said fly.

3. A trousers-fly-sewing apparatus according to claim 1, wherein said angle-changing member ascends and descends so as to abut on and retreat from said fly.

4. A trousers-fly-sewing apparatus according to claim 1, wherein said supply section is a lateral supply section which is disposed on a side of said fly-conveying passage and supplies said fly to said fly-conveying passage in a lateral direction of said fly-conveying passage.

5. A trousers-fly-sewing apparatus according to claim 4, wherein said lateral supply section has a plurality of follower rollers for supplying said fly, each follower roller being adjustable so that said side end portion of said fly abuts on said angle-changing member.

6. A trousers-fly-sewing apparatus according to claim 1, wherein said supply section is a longitudinal supply section which is on an upstream side of said fly-conveying passage and supplies said fly to said fly-conveying passage in a longitudinal direction of said fly-conveying passage.

7. A trousers-fly-sewing apparatus according to claim 6, wherein said longitudinal supply section is connected to said conveying section having a plurality of driving rollers, each driving roller having directions of rotary shafts which are adjustable so that said side end portion of said fly abuts on said angle-changing member.

8. A trousers-fly-sewing apparatus according to claim 1, wherein said conveying section has a longitudinal conveying belt which is disposed above said fly-conveying passage and which can ascend and descend, and said longitudinal conveying belt carries said fly to said sewing section while pressing said fly when said longitudinal conveying belt descends.

9. A trousers-fly-sewing apparatus according to claim 1, wherein said conveying section has a first longitudinal conveying belt and a second longitudinal conveying belt, said second longitudinal conveying belt is positioned between said sewing section and said first longitudinal conveying belt, such that a rear portion of said second longitudinal conveying belt on a side toward said first longitudinal belt can ascend and descend, and both succeeding and preceding flies can be simultaneously conveyed and successively conveyed to said sewing section of said slide fastener chain while being pressed after said succeeding fly is caused to abut on said preceding fly.

* * * * *